US005168961A

United States Patent [19]

Schneider

[11] Patent Number: 5,168,961

[45] Date of Patent: Dec. 8, 1992

[54] SUPERMARKET WITH SELF-SERVICE CHECKOUT

[76] Inventor: Howard Schneider, 149 Finchley Road, Montreal, Quebec H3X 3A3, Canada

[21] Appl. No.: 650,010

[22] Filed: Feb. 4, 1991

[51] Int. Cl.[5] ..... G07C 11/00

[52] U.S. Cl. ..... 186/52; 186/60; 186/61

[58] Field of Search ..... 186/52, 53, 55, 56, 186/59-61; 232/43.1, 43.4; 109/67, 68; 235/383; 194/905; 280/DIG. 4

[56] References Cited

U.S. PATENT DOCUMENTS

| | | | |
|---|---|---|---|
| 3,160,292 | 12/1964 | Albrecht | 186/52 X |
| 4,245,720 | 1/1981 | Neill, Jr. . | |
| 4,583,083 | 4/1986 | Bogasky . | |
| 4,676,343 | 6/1987 | Humble et al. | 186/61 |
| 4,779,706 | 10/1988 | Mergenthaler | 186/61 |
| 4,787,467 | 11/1988 | Johnson . | |
| 4,792,018 | 12/1988 | Humble et al. | 186/61 |
| 4,818,850 | 4/1989 | Gombrich et al. | 235/494 |
| 4,940,116 | 7/1990 | O'Connor et al. | 186/61 |

FOREIGN PATENT DOCUMENTS 3130543 2/1983 Fed. Rep. of Germany ..... 194/905

OTHER PUBLICATIONS

"Balance électronique de comptoir PRO 7500", Bizerba Catalog, Bizerba-Werke GmbH+Co. KG.

*Primary Examiner*—Robert J. Spar

[57] ABSTRACT

The present invention describes the incorporation of self-serve checkout systems within a supermarket. The installation of self-serve checkout systems is shown whereby the productivity of the supermarket is maintained, no significantly increased floorspace requirements occur, the human supervisor of the self-serve checkout systems is able to strategically carry out his/her duties and the co-existence with conventional checkout lanes is allowed. As well, a method and apparatus for integrating a labor savings car order bag handling system with the checkout lanes of the supermarket is shown. In addition, a method and apparatus for augmenting the checkout productivity of produce items is shown.

9 Claims, 11 Drawing Sheets

SUPERMARKET WITH SELF-SERVICE CHECKOUT

FIELD OF INVENTION

The present invention relates to self-service checkout stands, produce checkout, bagging areas and customer loading areas of supermarkets.

BACKGROUND OF THE INVENTION

Over the last two decades, automated retail point of sale systems have been proposed. These automated retail point of sale systems essentially allow the customer to scan himself or herself the bar codes that appear on many products and uniquely identify these products, or provide alternative product code entry mechanisms for products not possessing bar codes. The customer then places the product in an identification area. Eventually the customer or the system automatically moves the product to a bag packing or storage area.

Automated retail systems have typically been disclosed for usage in supermarkets as direct replacements for existing conventional lanes. For example, consider Humble, U.S. Pat. No. 4,676,343—Self-Service Distribution System. The self-service checkout stations of the Humble invention are placed in parallel lines much like conventional supermarket lanes. Note also that each self-service checkout station of the Humble invention occupies approximately the same amount of floorspace as a typical supermarket checkout lane. Since very few supermarkets have significant unused floorspace in the checkout area, the implication is the replacement of one conventional lane with one self-service checkout station in the same area previously occupied by the conventional lane. However, the productivity of a typical supermarket checkout lane involving a cashier and a bagger is approximately 30 products per minute, while the productivity of typical shopper using a self-serve checkout lane is typically only approximately 10 products per minute. Thus the direct replacement of a conventional supermarket lane with a self-serve checkout lane can result in a huge decrease in the checkout productivity of the supermarket. It is this factor which is mainly responsible at present for the reluctance of supermarket companies to install self-service checkout lanes.

All self-serve checkout systems require some human intervention, whether for payment, product identification or problem resolution. The floorspace required for the human supervisor station remains an additional problem.

Although self-serve checkout systems have the potential to save supermarkets significant labor costs, it is unlikely that many supermarkets will convert to uniquely self-serve checkout systems. Many customers will prefer, and may insist upon, the availability of conventional human cashier operated checkout lanes. Thus, the installation of self-serve checkout systems must be done in the context of co-existence with conventional checkout lanes. Thus the fixtures and passageways of the existing checkout area cannot generally be changed to accommodate the installation of self-serve checkout systems.

Produce items generally have no bar code labels affixed, and thus greatly reduce the productivity of self-serve checkout systems due to the necessity of requiring alternative non-scanning mechanisms to checkout such items. Thus, the installation of self-serve checkout systems requires a solution to the problem of significantly reducing the proportion of non-coded produce items.

Self-serve checkout systems must also operate in the context of bag handling modalities. In particular, car orders are frequent choice of customers. The customer typically tells the human cashier or bagger that a car order is desired. A bagger then typically places the packed bags directly in the car order area or on a conveyor system leading to the car order area. After payment of the order is effected, the cashier typically gives the customer a token for bags sent to the car order area. The customer then leaves the supermarket and drives in his/her car to the car order area. Upon receipt of the token, a car order area attendant then typically retrieves the customer's bags and typically places the bags in the customer's car. The self-serve checkout system must accommodate the choice of a car order and must provide arrangements for transfer of the customer's bags to the car order area and subsequent retrieval.

SUMMARY OF THE INVENTION

The present invention describes a method and apparatus for utilization of self-serve checkout stations within a supermarket. In a preferred embodiment of the present invention, the self-serve checkout stations each occupy approximately one-third the floorspace of a conventional lane. In approximately the floorspace of two conventional lanes, six self-serve checkout stations can be arranged as two lines of three self-serve checkout stations on opposing sides of the given floorspace. The lines of the self-serve checkout stations are typically parallel and adjacent to conventional checkout lanes. In between the two rows of self-serve checkout stations is space for shopping carts to proceed to the supermarket exit. As well, there is space for the self-serve checkout stations to receive shopping carts at a non-parallel angle. The latter arrangement allows customers in a single motion to reach in their shopping cart, remove a purchased product, scan the product and place the product in the identification area of the self-serve checkout station. At the exit end of the two rows of self-serve checkout stations is positioned the supervisor station and the human supervisor operating the supervisor station. Shopping carts leaving the checkout station area must pass in front of the supervisor station. The preferred embodiment of the present invention thus discloses a system whereby the productivity of the supermarket is maintained, no significantly increased floorspace requirements occur, the human supervisor of the self-serve checkout systems is able to strategically carry out his/her duties and the coexistence with conventional checkout lanes is allowed.

As well, a method and apparatus for integrating a labor savings car order bag handling system with the checkout lanes of the supermarket is shown. Customers use, typically without aid of the store employees, bag storage lockers located on the perimeter of the supermarket. After depositing packed bags in a bag storage locker, the inner door is locked, the customer leaves the supermarket to get his/her motor vehicle and returns to the location on the outside perimeter of the supermarket where the corresponding outside door of the particular bag storage locker is located. By entering an access code into a code input device such as keypad or machine code reader the outside door is unlocked and the customer can conveniently load his/her packed bags into the motor vehicle.

In addition, a method and apparatus for customer bar coding of produce items is disclosed whereby in a preferred embodiment of the present invention, preprinted rolls of bar code adhesive labels are kept adjacent to corresponding produce items so that customers can fix such labels onto the bags used to collect such product items. Thus, product code entry of typically non-bar coded produce items at the self-serve checkout station (as well as the conventional lanes to a lessor extent) is greatly simplified.

DESCRIPTION OF PREFERRED EMBODIMENTS AND PRACTICES

Figure 1:
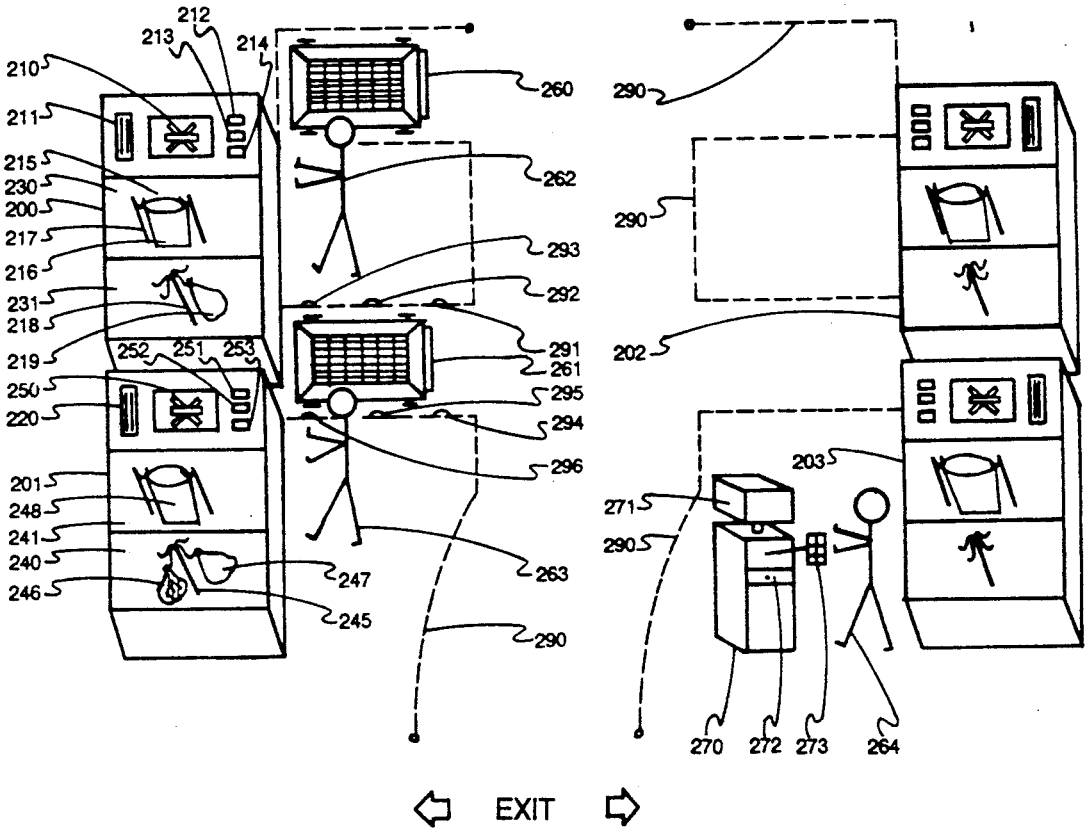
FIG. 1 is a schematic view of four self-serve checkout stations and a supervisor station in a supermarket.

FIG. 1 shows four self-serve checkout stations 200, 201, 202 and 203 and a supervisor station 270. Floor lines 290 show customers the paths they may take with their shopping carts. Customer 262 is using self-serve checkout station 200 to checkout his/her order. Note that customer 262's shopping cart 260 is at a non-parallel angle, in this case at an approximate right angle to the self-serve checkout station 200 and is positioned just at the start of the bar code scanner 210, as demarcated by lines 290. Such an arrangement allows customer 262 in a single motion to reach into shopping cart 260 for a purchased product, scan the purchased product over the bar code scanner 210 and then deposit the purchased product into bar 216.

The self-serve checkout stations shown in FIG. 1 are similar to the self-serve checkout stations described by Schneider U.S. Ser. No. 07/584,104 and thus reference should be made to the latter. However, the methods and apparatuses disclosed herein apply to most self-serve checkout stations conceivable. Buttons 212, 213 and 214 form part of a user input device and allow customers to indicate when an order is complete, when a produce item requires human supervisor approval or when human supervisor help is required. Video display 211 allows the self-serve checkout station display relevant information to the customer and prompts the customer for necessary information. Bag 216 is supported by bag holders 215 and 217 and rests on weighing scale platform 230. For the sake of clarity no overhead sensor is shown in FIG. 1, thus the human supervisor 264 is expected to be able to see any produce items requiring visual approval. For large orders, bags can be placed in the bagging area 231. In FIG. 1, in the case of checkout station 200, note bag 219 held by bag holder 218 resting on bagging area 231.

For the sake of clarity, only four self-serve checkout stations are illustrated in FIG. 1. Of course, it is possible to conceive of embodiments where there are different numbers of self-serve checkout stations, e.g., two rows of three each for six stations, or perhaps one row of three and another row of two for a five stations, or perhaps the supermarket is particularly large and there are several sets of the four self-serve checkout stations shown in FIG. 1.

Customer 263 is using checkout station 201. His/her grocery cart 261 is placed at approximately right angles to the checkout station 201 and at the start of the laser bar code scanner 250. In certain embodiments of the present invention, as shown in FIG. 1, as well as having lines 290 to guide the shopping carts into place, it is useful to have guides 291, 292, 293, 294, 295 and 296 which project from the floor and physically restrain the path that can be taken by shopping cart 261. Checkout station 201 is similar to checkout station 200. Buttons 251, 252 and 253 allow customer input choices. Display 220 allows customer prompting. Note bag 248 supported on weighing platform 241. Note bags 246 and 247 supported by bag holder 245 in bagging area 240.

Checkout stations 202 and 203 are of similar construction as checkout station 200 previously described. Note that the arrangement of the checkout stations is to allow a central passage of shopping carts.

Supervisor 264 supervises the operation of checkout stations 200, 201, 202 and 203. Supervisor 264 uses supervisor station 270 which contains a video display screen 271, a keypad 273 and a cash drawer 272. Supervisor 264 typically receives payment from customers, visually approves produce entries and provides customers with help in using the checkout stations. Note that the arrangement of the checkout stations in FIG. 1 allows the supervisor 264 to easily observe the actions of customers as well as seeing every customer leaving the checkout area. Note also that the arrangement of the checkout stations allows space for both the supervisor 264 and the supervisor station 270.

Figure 2:
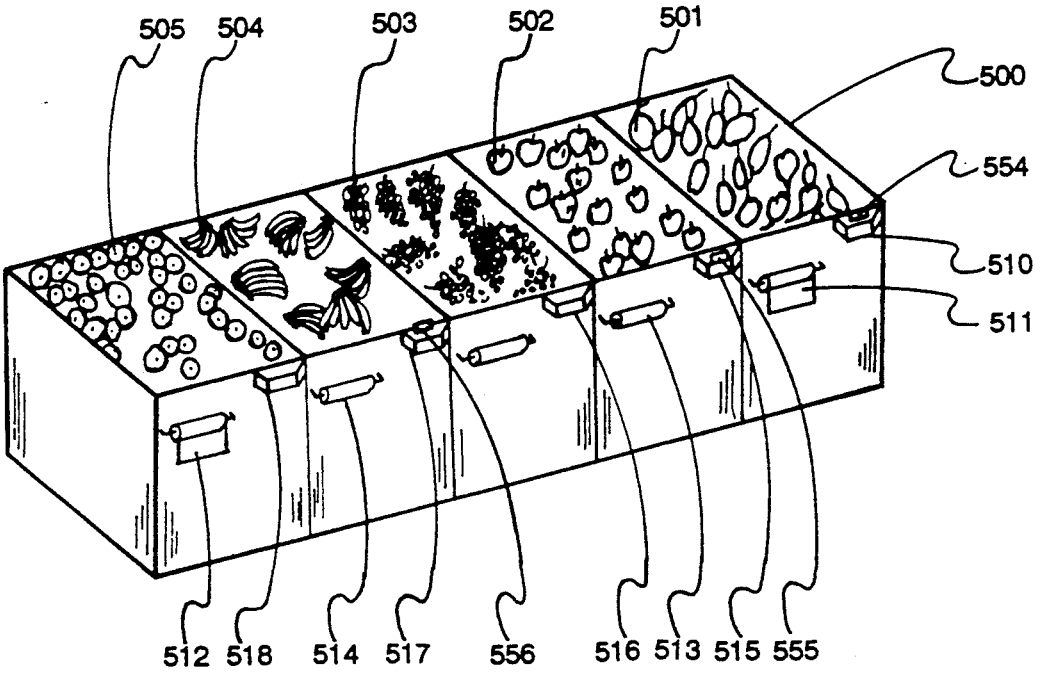
FIG. 2 is a perspective view of a produce stand, bag holder and bags and label holder and labels in a supermarket.
Figure 3:
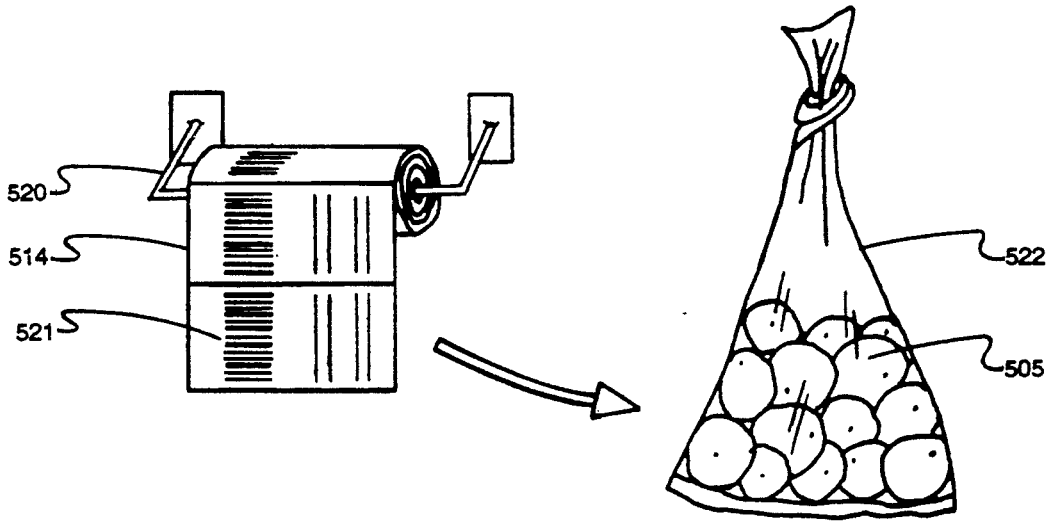
FIG. 3 is a perspective view showing the application of a label to a bag of produce.
Figure 4:
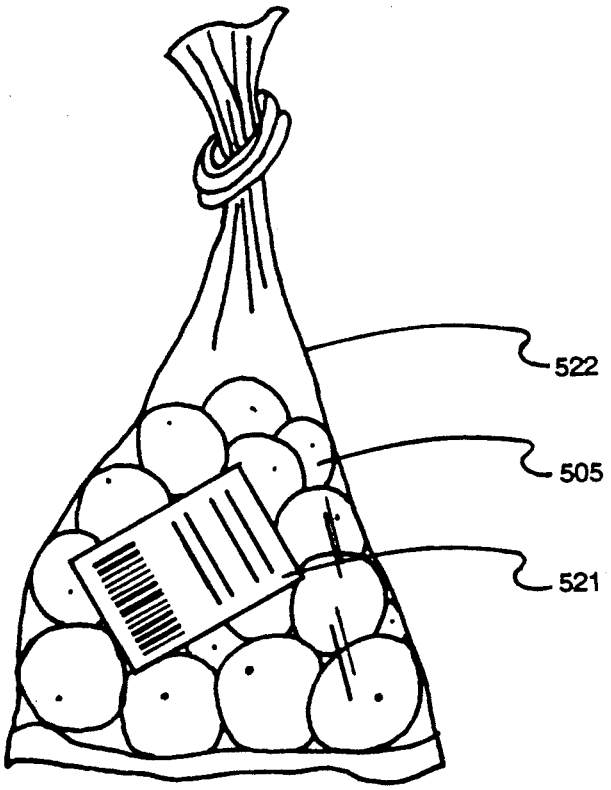
FIG. 4 is a perspective view of a bag of produce with a bar coded label applied thereon.

A major factor in the productivity of checkout stations 200, 201, 202 and 203 is the entry of produce items. Often such items will not have a bar code. Thus, if customer 262 has purchased a produce item, he/she must enter a description of the item via manipulation of buttons 212, 213 and 214, or in the case of beginner customers or where the customer has difficulty doing so, the supervisor 264 can enter the produce code via keypad 273. It is thus evident that such produce items slow down the checkout productivity. FIG. 2 illustrates a partial solution to the problem of non-coded produce items. In FIG. 2 produce stand 500 contains oranges 505, bananas 504, grapes 503, apples 502 and pears 501. Bags 511 and 512 are the typical thin, clear plastic bags provided to customers for self-wrapping of produce items. Note also rolls of adhesive bar code labels 513 and 514 and trays 510, 515, 516 and 518 holding adhesive bar code labels 554, 555, and 556. FIG. 3 shows a roll of bar code labels 514 supported by roller support 520 where label 521 is being applied to plastic bag 522 containing oranges 505. FIG. 4 shows plastic bag 522 containing oranges 505 with label 521 applied. Note that because of the adjacent position of the bar coded labels and the plastic wrapping bags and the produce stand, that with very little extra work the customer has prepared the purchased produce for rapid checkout by checkout stations 200, 201 202 or 203 of FIG. 1. Of course, the produce must still be verified as to the authenticity of the product with regards to the bar code scanned, but this would have to be done in the case of manual entry of produce code. The work of produce code or description entry at the checkout stand, however, has been eliminated, thereby increasing the productivity of the self-serve checkout system.

The embodiment of the present invention thus described can be summarized as a supermarket merchandising system comprising: (a) shopping carts; (b) shelves containing products wherein a customer places selected products in a said shopping cart; (c) produce stands containing dispensers holding produce bags and dispensers holding preprinted bar coded labels wherein said bar codes on said preprinted bar coded labels are indicative of the product code corresponding to the adjacently located produce and wherein the customer fixes a said preprinted bar coded label to a selected produce bag; (d) self-service checkout stations, containing laser bar code scanners, for receiving at an approximately perpendicular angle said shopping carts such that the ends of said shopping carts are within one meter of the said laser bar code scanners and wherein the customer uses a said laser bar code scanner to read the said preprinted bar coded labels on the selected produce bags and to read bar coded labels on the products selected from the said shelves; (e) the placement of said self-service checkout stations in two opposing rows, wherein said rows each consist of a plurality of said self-serve checkout stations, wherein exit movement of said shopping carts occurs between scanning sides of said two opposing rows; and (f) a supervisor station at an end of the said two opposing rows of self-service checkout stations such that said shopping carts must pass adjacent to said supervisor station upon exiting the rows.

Figure 5:
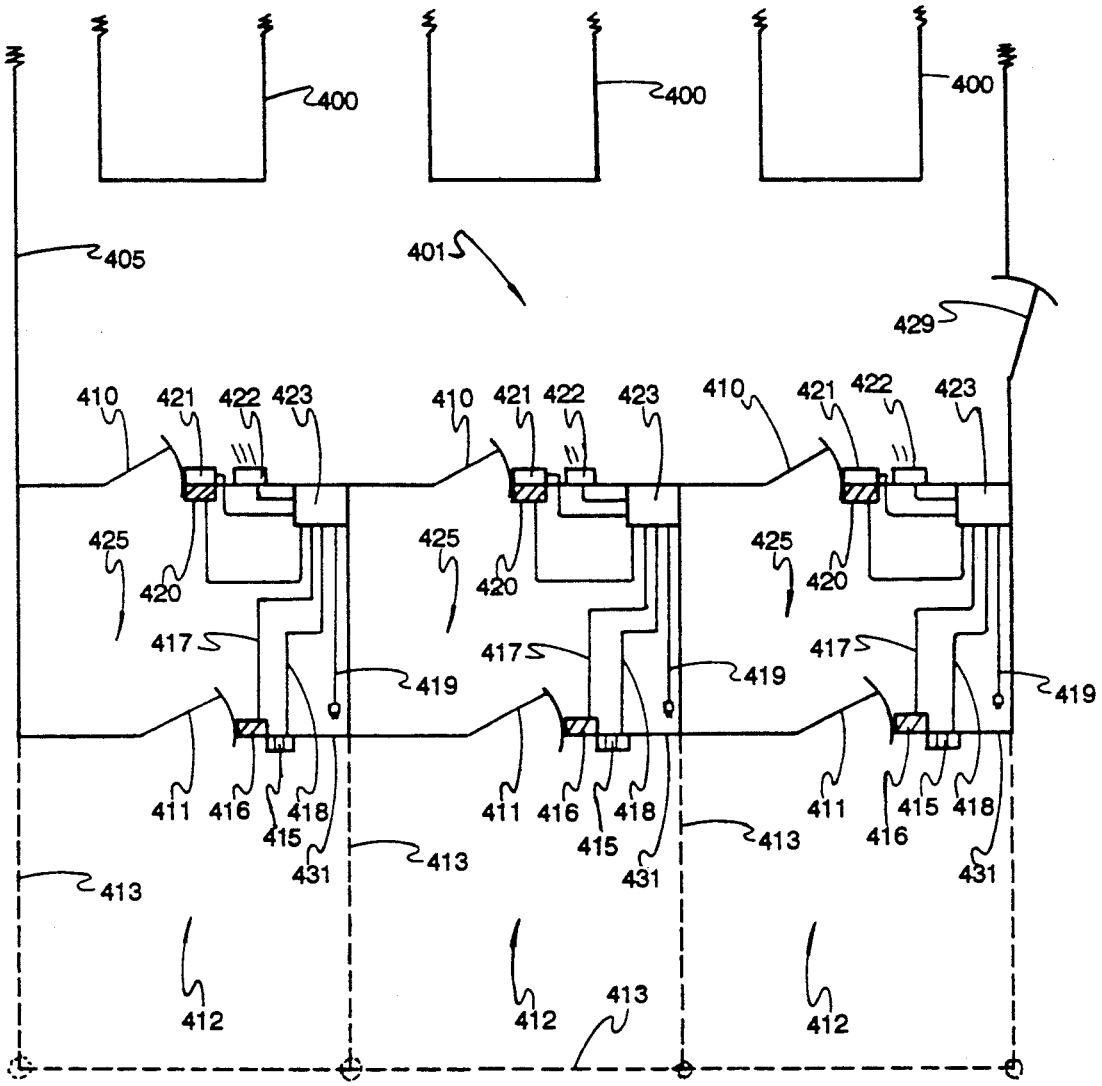
FIG. 5 is a plan view of three bag lockers and the corresponding car pickup spots.
Figure 6:
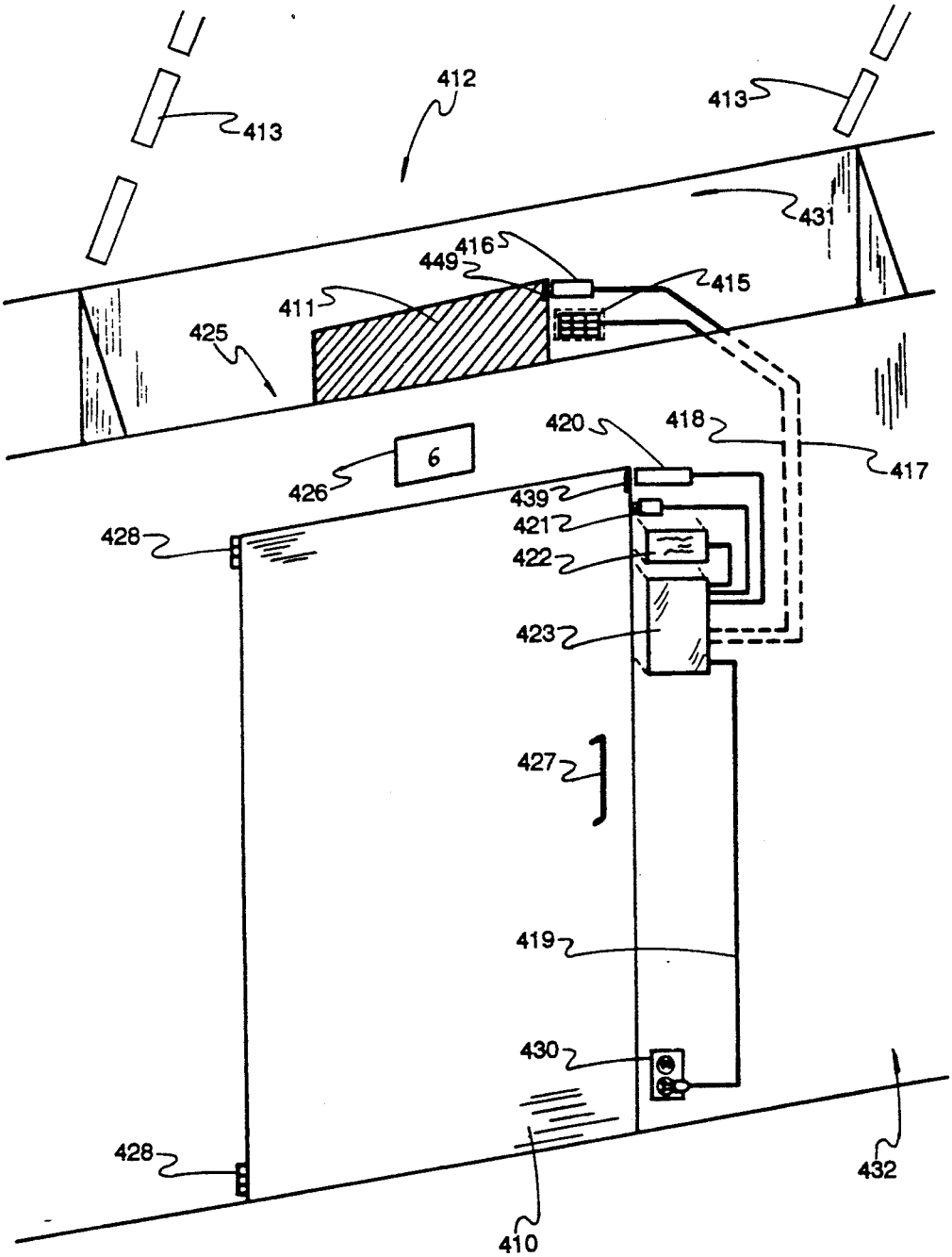
FIG. 6 is a perspective view of a bag locker with the ceiling removed for illustrative purposes.

The self-serve checkout stations shown in FIG. 1 do not have associated baggers. What does the customer do for car orders? FIG. 5 discloses a solution to the problem of car orders that not only saves the labor of the bagger in transporting the packed bags to the car order area, but also saves the labor required in having an attendant in the car order area giving various customers their bags. FIG. 5 is a plan view of a portion of supermarket 405. The ends of checkout stations (or conventional lanes) 400 are shown in the top portion of the figure. After checking and paying for their orders, customers will find themselves in area 401, typically with their packed bags in shopping carts, or in the case of smaller orders with customers holding their packed bags in their hands. Certain customers may then leave the supermarket via door 429. However, customers with cars who want to save the trouble of carrying or carting their order to the car, will typically proceed into one of three bagging lockers 425 shown in FIG. 5. Reference should also be made to FIG. 6 which is a perspective view of a bag locker 425 with the ceiling removed for illustrative purposes. If a bagging locker 425 is vacant then door 410, containing handle 427 and affixed to wall 432 with hinges 428, will typically be unlocked, and the vacant status may be indicated via display means 422 (which can range from single light source to a color video display screen). The customer then typically proceeds to place his/her shopping cart in bagging locker 425. The customer then leaves bagging locker 425 and upon closing the door, is shown a password by display 422. Note that sensor 421, typically a contact switch or a magnetic proximity detector, can sense whether the door 410 is open or closed. After closing the door 410, latch 420, typically a solenoid mechanical latch or a magnetic latch, engages catch 439 thereby locking door 410. The customer then will typically proceed to the parking lot and return in his/her car to loading spot 412, demarcated by lines 413. The customer uses password entry device 415, typically a keypad, to enter the password previously displayed on display 422. If the correct password is entered, latch 416 will disengage from catch 449 thus allowing the customer to retrieve his/her order for placement in his/her car conveniently parked now in loading area 412.

Note from FIG. 5 that the rear door 411 attached to rear wall 431 is narrower than the front door 410. The intention in the embodiment shown in FIG. 5 is to allow customers to place a shopping cart within the bagging locker 425 but to impede the customer from removing the shopping cart out of the store into the loading area 412 where the shopping cart can be lost or stolen. Of course, many variations of this theme are conceivable in various embodiments of the present invention. Note from FIG. 6 that an identifying sign 426 is present, in this case the number '6'. Although not shown in FIG. 5 nor FIG. 6, a similar sign bearing the number '6' should be presented adjacent to the rear door 411 of that specific bagging locker 425 so as to allow the customer locate the correct bagging locker. Note also from FIG. 5 and FIG. 6 that latch 416 and password entry device 415 are respectively electronically connected by wire cables 417 and 418 to baggage locker controller 423. Baggage locker controller 423 is also attached electronically to latch 420, door sensor 421, and display 422. Baggage locker controller 423 receives electric power from electrical outlet 430 via power cable 419. As one skilled in the art is aware, other means exist to power baggage locker controller 423 and other means also exist to allow communication between baggage locker controller 423 and the various sensors and effectors. As well, in other embodiments, rather than have a single controller for each bagging locker, it is conceivable to have a centralized controller controlling all of the lockers.

Figure 7:
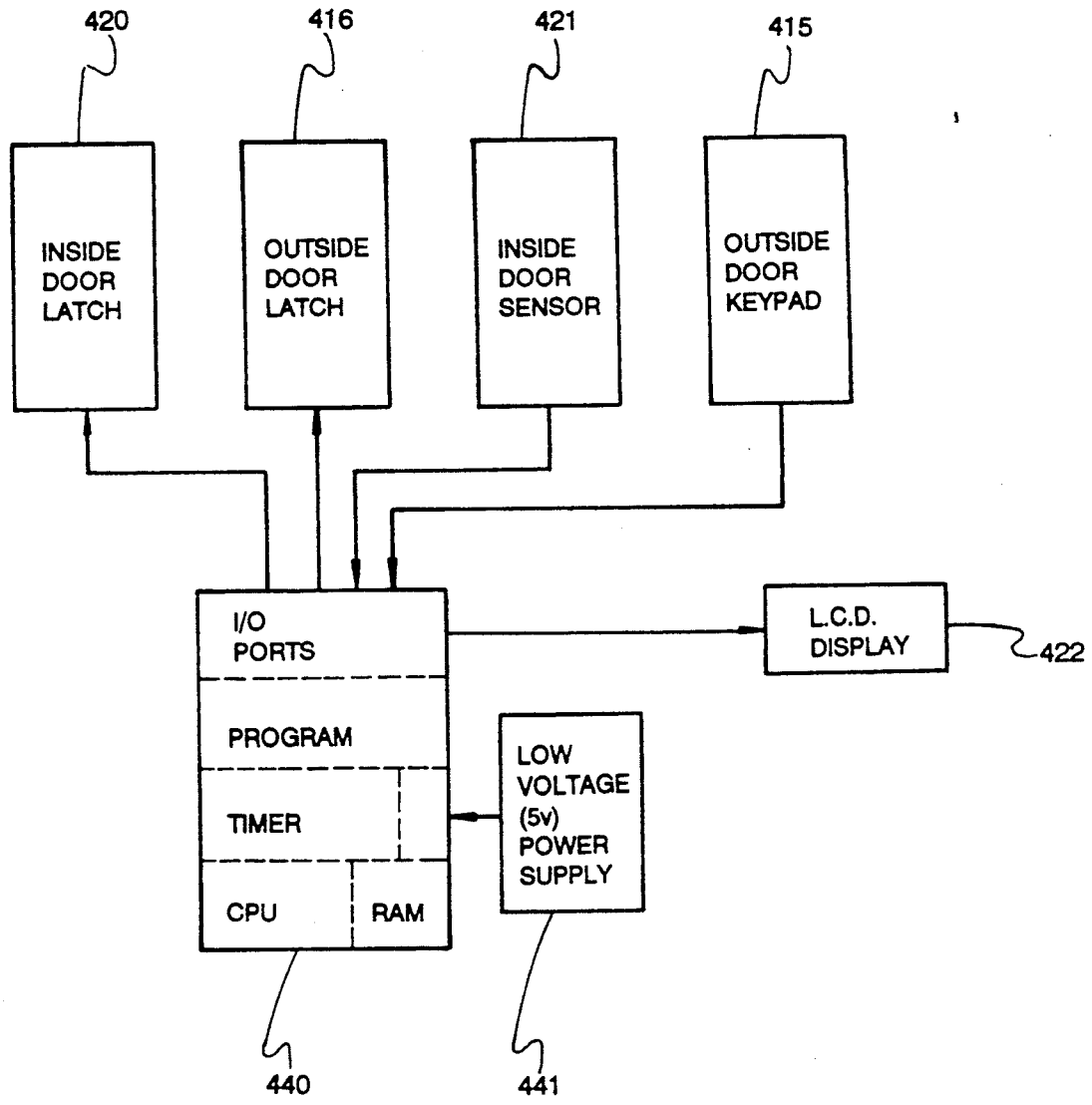
FIG. 7 is a functional diagram of the door locking system of a bag locker.

FIG. 7 is a functional diagram of the electrical equipment used in bagging locker 425 shown in FIG. 6. The utilisation of the inside door latch 420, the outside door latch 416, the inside door sensor 421 and outside door keypad 415 and display 422 (which is described in FIG. 7 as a LCD or liquid crystal display) have been described above. Highly integrated semiconductor circuits such as circuit 440 are commercially available which contain on a single chip almost all of the required electronic circuitry of the bag locker controller 423. A power supply, such as low voltage power supply 441, is necessary to power circuit 440. Circuit 440 contains I/O (input/output) port circuitry to receive signals from the inside door sensor 421 and the outside door keypad 415 and to send signals to the inside and outside door latches 420 and 416. Circuit 440 contains CPU (central processing unit) circuitry which controls the signals received and sent by the I/O ports and which is in turn controlled by a program stored within circuit 440. Circuit 440 also contains a timer circuit to send required timing pulses and RAM (random-access-memory) for intermediate result storage.

Figure 8:
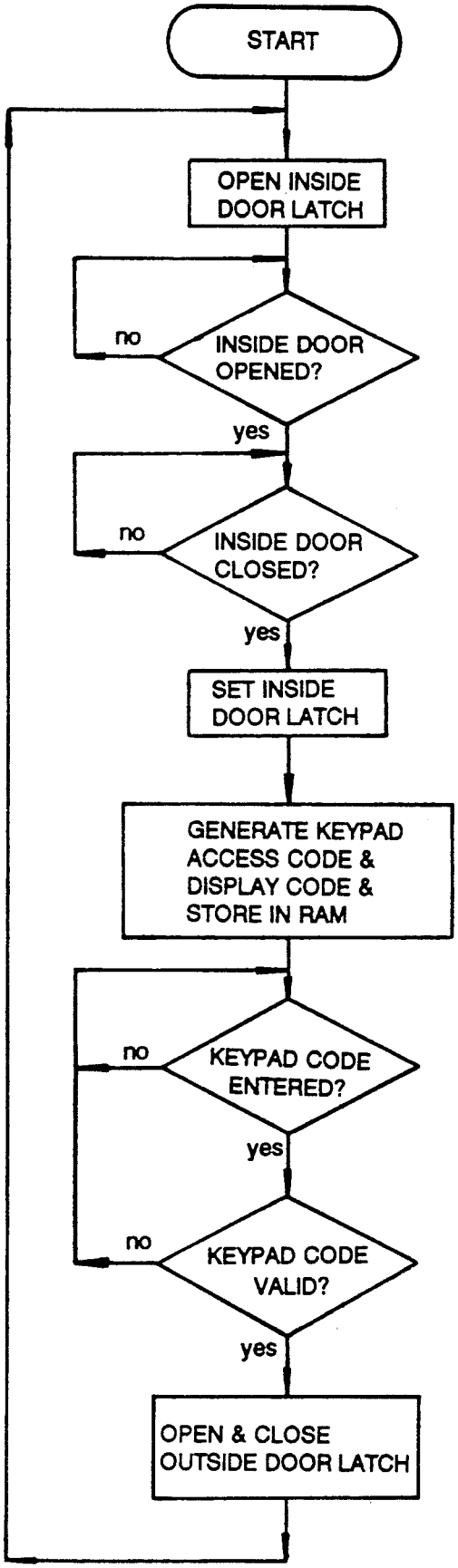
FIG. 8 is a logical diagram of the door locking system of a bag locker.

FIG. 8 is a logic diagram of the algorithm which is stored in the program area of circuit 440 and which the CPU of circuit 440 follows. Many other functionally equivalent algorithms are conceivable in other embodiments of the present invention. As well, for the sake of clarity much of the housekeeping and error control logic is not shown in FIG. 8. For example, logic is required to account for situations where the customer forgets his/her password, to prevent accidental door locking while a customer is within the bagging locker, to account for customers opening and closing doors but not really storing anything within the bagging locker, etc. Such additions are obvious modifications and enhancements to one skilled in the art. In the simple algorithm shown in FIG. 8, the program starts by releasing the inside door latch. The program then waits for a customer to open the inside door. Once the inside door has been opened, i.e., indicating that the customer has gone inside to place his/her order, the program waits for the inside door to close indicating that the customer has left the bag locker. At this point, the program causes the CPU of circuit 440 to send a signal to the inside door latch 420 to lock the inside door 410. The program then generates a random keypad access code and displays this code on LCD display 422. The program also causes this code to be temporarily saved in RAM of circuit 440. The program then causes the CPU of circuit 440 to survey the outside door keypad 415. After the customer has entered a code on the outside door keypad 415 the program checks to see if this code is valid, i.e., does it match the code saved in the RAM of circuit 440. If the code entered is valid then the program causes the CPU of circuit 440 to send via the I/O ports of circuit 440 a signal to the outside door latch 416 to release the latch to allow the customer to open outside door 411. The program waits for a short time delay to occur, i.e., enough time to have allowed the customer to open door 411 and then resets latch 416 so that it will engage catch 449 when the door 411 is closed. At this point, the program starts over by opening the inside door latch 420.

Figure 9:
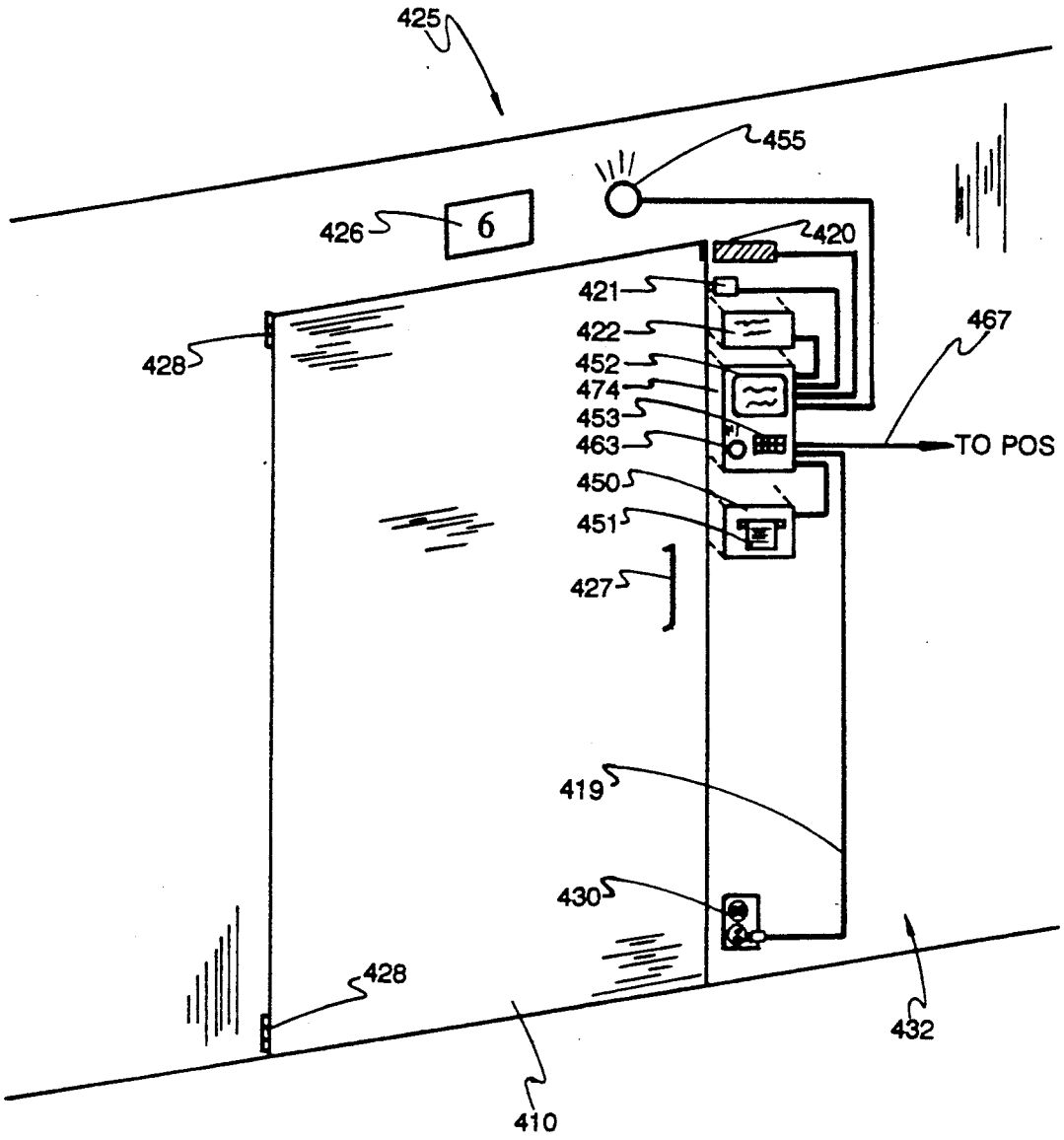
FIG. 9 is a front view of a bag locker.

Many variations and enhancements of the embodiment of the bag storage locker presented above are possible. FIG. 9 shows another embodiment of the bag storage locker, in particular the inside door 410 aspect. Note that a large display light 455 is present. Display light 455 could be used to inform customers whether that the particular bag storage locker is occupied or vacant. Bag storage locker controller 474 contains printed instructions 452, a bar code reader 463 and a keypad 453. Printer 450 is capable of printing a record of a password code in alphanumeric and/or bar code form such as printout 451 shown in the illustration. Printer 450 typically attaches electronically to bag storage locker controller 474 although in certain embodiments it could function independently as code generating mean where a random access code is printed which the customer uses (i.e., enters manually or scans if a bar coded access code is printed and bar code readers are available at the inside and outside doors 410 and 411) to open the inside door 410 (or perhaps enters after the inside door 410 is closed) and then uses again to open the outside door 411. Note also that cable 467 connects the bag storage locker controller 474 to the POS (point of sale) system(s) of the supermarket. The outside wall of the bag storage locker is not shown, but it too could contain a bar code reader. In such an embodiment, the customer could receive a bar coded ticket containing a random code, from a self-serve checkout station, or a conventional checkout lane possessing an appropriate printer or an independent code generating and printing unit as described above, and scan the code at bar code reader 463. The code would be placed in temporary memory of the bag storage locker controller 474 which would wait for the same code to be read from the outside door bar code reader in order to open the outside door. Or in other embodiments, if such a ticket could not be produced by the checkout systems of the supermarket, the password code needed to cause the outside door to open could be displayed on display 422 as well as printed by printer 450, and the customer would need only read this printed ticket on the outside door bar code reader in order to cause the outside door to open. In other embodiments, the checkout point of sale system could see which bag storage locker is free and instruct the customer to proceed to that particular locker. Although not shown in FIG. 9, other embodiments may include sensors within the bag storage locker 425 sensing whether bags or shopping carts remain within the bag storage locker 425. Keypad 453 is useful if the customer wants to open the door again, or if the manager of the supermarket wants to open the door, e.g., the customer lost the coded password.

Figure 10:
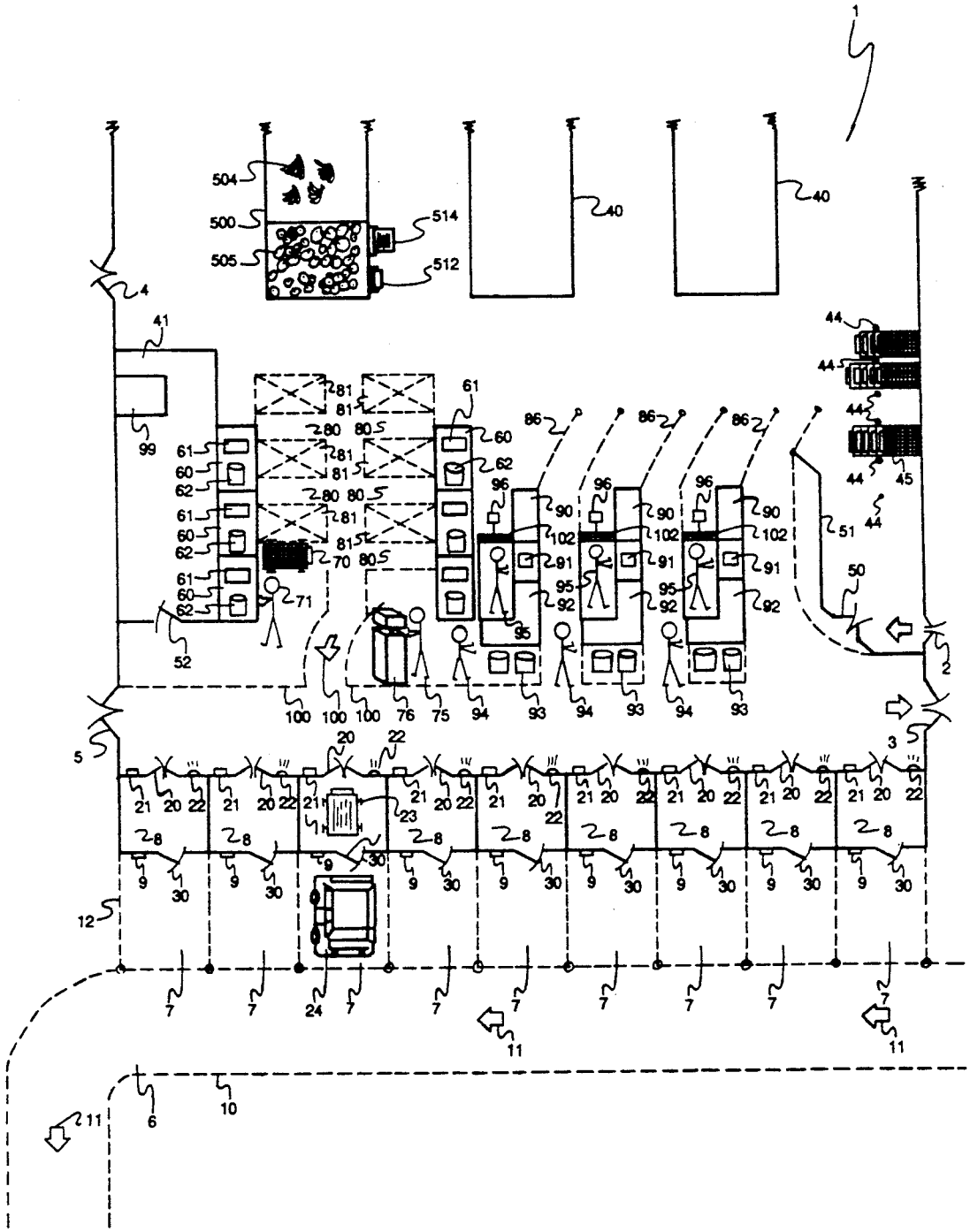
FIG. 10 is a plan view of a supermarket incorporating self-serve checkout features.

FIG. 10 is a plan view of a portion of a supermarket 1 incorporating the self-serve features discussed herein. Customers enter supermarket 1 through door 2. Customers can obtain a shopping cart 45 from the shopping carts within guideposts 44, or from vacated bag storage lockers 8 via doors 50, where wall 51 separates the 'in' and 'out' stream of customers. Customers can then proceed with their shopping cart 45 along the aisles 40 placing various products in their shopping cart for purchase. The oranges 505 and the bananas 504 of produce stand 500 are shown in FIG. 10. Note the wrapping bags 512 and preprinted bar code labels 514 adjacent to the oranges 505. After the customer places oranges 505 for purchase in a wrapping bag 512, he/she then applies a bar code label 514 where in this case label 514 is coded for the particular type of orange 505. Thus, when the customer presents at a self-serve checkout stand 60 or even a conventional checkout stand containing a bar code scanner 91, no time need be wasted to enter the produce code for that particular type of orange into the point of sale system.

Emergency escape doors 4 and 5 are not normally used by customers and may include an alarm to discourage non-emergency use. The supermarket manager's office 41 is to one side of the supermarket in this embodiment, is entered through door 52 and contains minicomputer 99 which communicates with all the self-serve checkout stations 60 and the supervisor station 76 as well as the scanners 91, the display 96 and the keypad 102 of the conventional checkout lanes. Floor lines 86 demarcate waiting areas and paths for customers to take to utilize a conventional checkout lane staffed by a human cashier 95 and a human bagger 94. Customers typically remove items from their shopping carts and place these items onto conveyor belt 90. At the end of the conveyor belt near the cashier 95, the cashier 95 scans the products's bar codes via scanner 91 or if bar codes are absent enters the appropriate code via keypad 102 and then places the product on bagging surface 92. The bagger 94 takes the product on bagging surface 92 and places it into bag 93.

The utilization of self-serve checkout stations 60 is as described previously. For example, customer 71 has placed his/her shopping cart 70 (i.e., one of the shopping carts 45 selected for his/her usage) at approximately a right angle to the self-serve checkout station 60. Due to the positioning of the shopping cart 70, the laser bar code scanner 61 and the bag 62, customer 71 can in a single motion remove a purchased item from shopping cart 70, scan the item via laser bar code scanner 61 and then place the item into bag 62. Self-serve checkout stations supervisor 75 uses supervisor station 76 as discussed previously. Floor lines 81 demarcate the paths customers may take with their shopping carts to use the self-serve checkout stations 60, typically placing the shopping carts in the regions 80 between the lines 81. The regions where lines 81 form a cross are regions where the customer typically stands. However, in other embodiments, depending upon the exact dimensions involved, there may be enough space in these latter regions to allow a waiting space for the next shopping cart. Floor markings 100 guide the customer in leaving the self-serve checkout area.

If a customer wishes to have a car order, he/she enters bag storage locker 8 via doors 20 and leaves his/her shopping cart, for example shopping cart 23, of the same type as shopping carts 45, shown in FIG. 10, in the bag storage locker 8. The customer then leaves the bag storage locker 8, closes doors 20 and receives via display 21 a password. The customer then leaves the supermarket through exit door 3 and returns with his/her car 24 in the bag storage locker loading area 7. The customer then enters via keypad 9 the password thus enabling him/her to open door 30 and place the packed bags present in shopping cart 23 into car 24. After closing door 30, light 22 is illuminated indicating to customers entering the supermarket that an empty shopping cart is available in that bag storage locker for their usage. The customer then drives off in car 24, following lines 12 to leave the bag loading area 7 and then lines 10 and arrows 11 of road 6.

FIG. 10 describes a method for shopping in a supermarket which can be summarized as comprising the steps of: (a) obtaining a shopping cart at the entrance of said supermarket; (b) pushing said shopping cart among shelves containing products where the customer places selected products in said shopping cart; (c) pushing said shopping cart among produce stands containing dispensers holding produce bags and dispensers holding preprinted bar coded labels where said bar codes on said preprinted bar coded labels are indicative of the product code corresponding to the adjacently located produce and where the customer fixes a said preprinted bar coded label to a said produce bag and where said produce bag is then placed in said shopping cart; (d) pushing sai shopping cart to a self-service checkout station, containing a laser bar code scanner, for receiving at a non-parallel angle said shopping cart such that the end of said shopping cart is within one meter of the said laser bar code scanner and where the customer uses said laser bar code scanner to read the said preprinted bar coded labels on the said produce bags and to read the bar coded labels on the products selected from the said shelves; (e) exit movement of said shopping cart in the middle of two opposing rows of self-service checkout stations; (f) pushing said shopping cart past a supervisor station at the exit end of the said two opposing rows of self-service checkout stations; (g) pushing said shopping cart to a bag storage locker comprising access code generating and printing means, inside door means, an outside door means, a secured bag storage area between said inside door means and said outside door means, first electronically controlled locking means whereby said first electronically controlled locking means changes the locking status of the said inside door means upon reception of a first signal, second electronically controlled locking means whereby said second electronically controlled locking means changes the locking status of the said outside door means upon reception of a second signal, inside door means sensor means where said sensor means generates a third signal indicative of the opened vs. closed status of said inside door means, inside perimeter code input means where said code input means generates a fourth signal indicative of the entered access code, outside perimeter code input means where said code input means generates a fifth signal indicative of the entered access code, data communications means for linking said first and second electronically controlled locking means, said sensor means, said inside and said outside code input means to a controller means where said controller means is operable for upon reception of said fourth signal the transmission of said first signal to unlock said inside door means, and upon subsequent reception of said third signal indicative of bags being placed within the said secured bag storage area and said inside door means being in a closed position the transmission of said first signal to lock said inside door means, and upon reception of said fifth signal where said fifth signal corresponds with the said fourth signal, the transmission of said second signal to unlock said outside door means; (h) leaving purchased goods in said bag storage locker; and (i) exiting the supermarket and returning to the outside perimeter location of said bag storage locker for retrieval of said purchased goods left in said bag storage locker.

Figure 11:
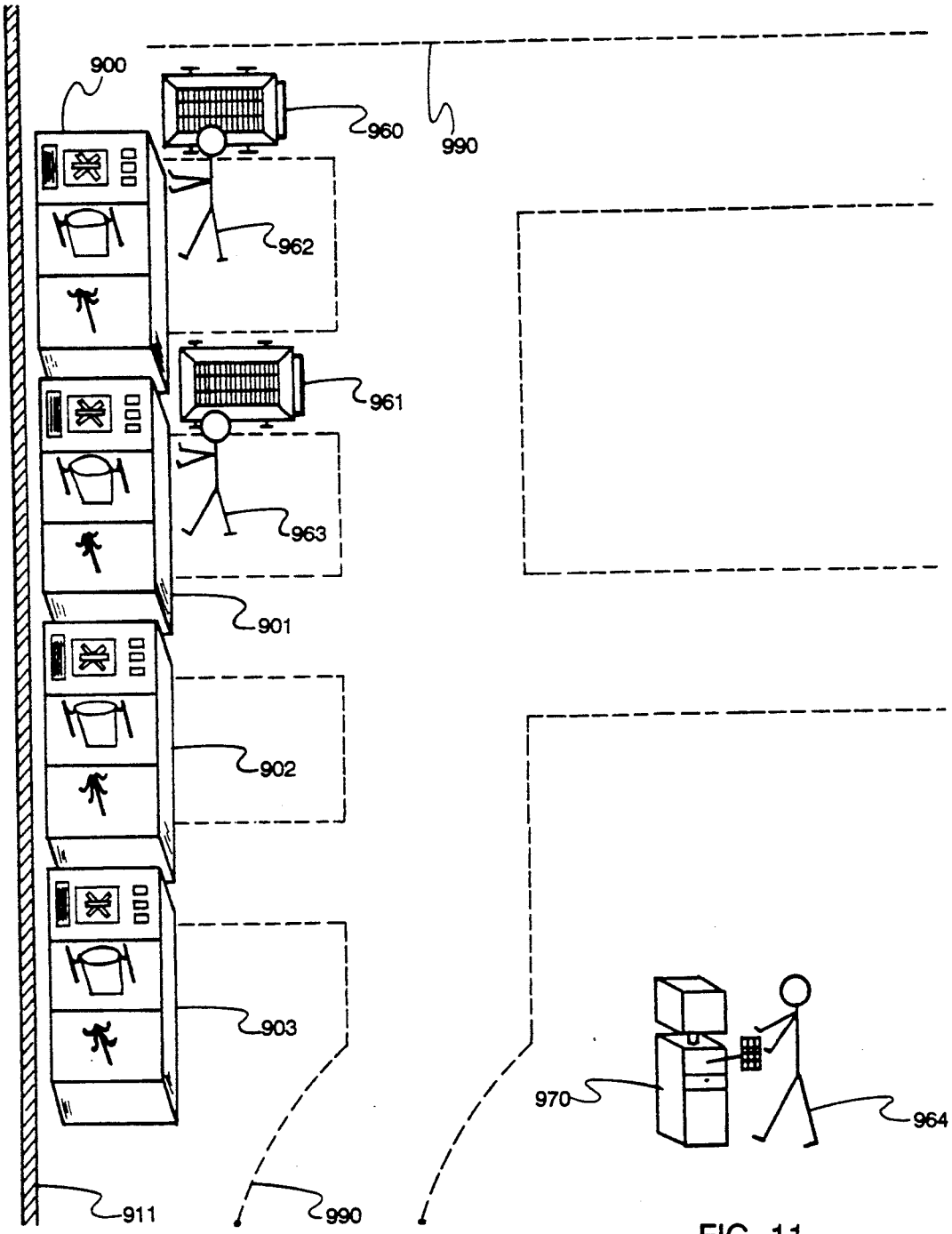
FIG. 11 is a schematic view of an alternative embodiment of the present invention involving four self-serve checkout stations and a supervisor station in a supermarket.

FIG. 11 is a schematic view of an alternative embodiment of the present invention. As mentioned earlier, two of the important constraints in creating a supermarket retail merchandising system employing self-serve checkout stations is the typical necessity of replacing one conventional checkout lane with three self-serve checkout stations and the typical lack of any significant additional floorspace in the checkout area. Thus, for most supermarkets envisioned, the preferred embodiment of the present invention illustrated in FIG. 1 is the ideal embodiment. However, a small percentage of supermarkets will have some wasted space after the checkout area, typically along a perimeter wall(s). For such supermarkets, FIG. 11 discloses an alternative embodiment of the present invention which will be useful. In FIG. 11 note that self-service checkout stations 900, 901, 902 and 903, all similar to self-service checkout stations 200, 201, 202 and 203 of FIG. 1, are placed end-to-end along perimeter wall 911. As the shopping cart 960 of customer 962 and the shopping cart 961 of customer 963 illustrate, the non-parallel angle between the shopping cart and the checkout station is maintained in this embodiment. Floor lines 990 guide the customers and their shopping carts to the checkout stations and to the exit of the checkout region. Note that customers upon leaving the checkout region will pass in front of supervisor 964 and supervisor station 970.

Those skilled in the art will be able to ascertain, using no more than routine experimentation, other equivalents for the method and apparatus above described.

Such equivalents are to be included within the scope of the following claims.

I claim:

1. A supermarket merchandising system comprising:

(a) shopping carts;

(b) shelves containing products wherein a customer places selected products in a said shopping cart;

(c) produce stands containing dispensers holding produce bags and dispensers holding preprinted bar coded labels wherein said bar codes on said preprinted bar coded labels are indicative of the product code corresponding to the adjacently located produce and wherein the customer fixes a said preprinted bar coded label to a selected produce bag;

(d) self-service checkout stations, containing laser bar code scanners, for receiving at a non-parallel angle said shopping carts such that the ends of said shopping carts are within one meter of the said laser bar code scanners and wherein the customer uses a said laser bar code scanner to read the said preprinted bar coded labels on the selected produce bags and to read bar coded labels on the products selected from the said shelves;

(e) the placement of said self-service checkout stations in two opposing rows wherein exit movement of said shopping carts occurs in the middle of said two opposing rows;

(f) floor markings indicating movement paths to and from said self-service checkout stations for said shopping carts;

(g) a supervisor station at an exit end of the said two opposing rows of self-service checkout stations such that said shopping carts must pass adjacent to said supervisor station upon exiting the rows; and (h) whereby a customer desiring car order service, upon leaving a said self-serve checkout station proceeds with packed bags to a bag storage locker located on the inside perimeter of the supermarket wherein said packed bags are deposited through an inside door means within said bag storage locker, after which the customer leaves the supermarket and returns with a motor vehicle to a location on the outside perimeter of the supermarket corresponding to outside door means of the said bag storage locker containing the customer's said packed bags and whereupon the entry of a valid code into an outside input code device means the outside door means of the said bag storage locker containing the customer's said packed bags is unlocked enabling the customer to then remove the said packed bags for placement in the said motor vehicle.

2. A supermarket merchandising system comprising:

(a) shopping carts;

(b) shelves containing products wherein a customer places selected products in a said shopping cart;

(c) produce stands containing dispensers holding produce bags and dispensers holding preprinted bar coded labels wherein said bar codes on said preprinted bar coded labels are indicative of the product code corresponding to the adjacently located produce and wherein the customer fixes a said preprinted bar coded label to a selected produce bag;

(d) self-service checkout stations, containing laser bar code scanners, for receiving at a non-parallel angle said shopping carts such that the ends of said shipping carts are within one meter of the said laser bar code scanners and wherein the customer uses a said laser bar code scanner to read the said preprinted bar coded labels on the selected produce bags and to read bar coded labels on the products selected from the said shelves;

(e) the placement of said self-service checkout stations in two opposing rows wherein exit movement of said shopping carts occurs in the middle of said two opposing rows;

(f) floor markings indicating movement paths to and from said self-service checkout stations for said shopping carts;

(g) a supervisor station at an exit end of the said two opposing rows of self-service checkout stations such that said shopping carts must pass adjacent to said supervisor station upon exiting the rows; and (h) in the perimeter of the supermarket, at least one bag storage locker comprising:

(a) an inside door means;

(b) an outside door means;

(c) a secured bag storage area between said inside door means and said outside door means;

(d) first electronically controlled locking means whereby said first electronically controlled locking means changes the locking status of the said inside door means upon reception of a first signal;

(e) second electronically controlled locking means whereby said second electronically controlled locking means changes the locking status of the said outside door means upon reception of a second signal;

(f) inside door means sensor means wherein said sensor means generates a third signal indicative of the opened vs. closed status of said inside door means;

(g) inside perimeter display means wherein said display means receives a fourth signal and wherein said display means displays information indicative of said fourth signal;

(h) outside perimeter code input means wherein said code input means generates a fifth signal indicative of an entered code;

(i) data communications means for linking said first, second, third, fourth and fifth signals to a controller means; and (j) said controller means operable for I. upon reception of said third signal indicative of said inside door means being in a closed position, the generation and transmission of the fourth signal to the said display means and the subsequent display on said display means of an access code and the transmission of said first signal to lock said inside door means;

II. upon reception of said fifth signal, wherein said fifth signal corresponds with the said access code, the transmission of said second signal to unlock said outside door means.

3. A supermarket merchandising system comprising:

(a) shopping carts;

(b) shelves containing products wherein a customer places selected products in a said shopping cart;

(c) produce stands containing dispensers holding produce bags and dispensers holding preprinted bar coded labels wherein said bar codes on said preprinted bar coded labels are indicative of the product code corresponding to the adjacently located produce and wherein the customer fixes a said preprinted bar coded label to a selected produce bag;

(d) self-service checkout stations, containing laser bar code scanners, for receiving at a non-parallel angle said shopping carts such that the ends of said shopping carts are within one meter of the said laser bar code scanners and wherein the customer uses a said laser bar code scanner to read the said preprinted bar coded labels on the selected produce bags and to read bar coded labels on the products selected from the said shelves;

(e) the placement of said self-service checkout stations in two opposing rows wherein exit movement of said shopping carts occurs in the middle of said two opposing rows;

(f) floor markings indicating movement paths to and from said self-service checkout stations for said shopping carts;

(g) a supervisor station at an exit end of the said two opposing rows of self-service checkout stations such that said shopping carts must pass adjacent to said suppervisor station upon exiting the rows; and (h) in the perimeter of the supermarket, at least one bag storage locker comprising:

(a) an inside door means;

(b) an outside door means;

(c) a secured bag storage area between said inside door means and said outside door means;

(d) first electronically controlled locking means whereby said first electronically controlled locking means changes the locking status of the said inside door means upon reception of a first signal;

(e) second electronically controlled locking means whereby said second electronically controlled locking means changes the locking status of the said outside door means upon reception of a second signal;

(f) inside door means sensor means wherein said sensor means generates a third signal indicative of the opened vs. closed status of said inside door means;

(g) wherein said self-service checkout station generates an access code and prompts the customer to the value of said access code and generates a fourth signal indicative of said access code;

(h) outside perimeter code input means wherein said code input means generates a fifth signal indicative of an entered code;

(i) data communications means for linking said first, second, third, fourth and fifth signals to a controller means; and (j) said controller means operable for I. upon reception of said third signal indicative of said inside door means being in a closed position the transmission of said first signal to lock said inside door means;

II. upon reception of said fifth signal where said fifth signal corresponds with the said fourth signal, the transmission of said second signal to unlock said outside door means.

4. A supermarket merchandising system comprising:

(a) shopping carts;

(b) shelves containing products wherein a customer places selected products in a said shopping cart;

(c) produce stands containing dispensers holding produce bags and dispensers holding preprinted bar coded labels wherein said bar codes on said preprinted bar coded labels are indicative of the product code corresponding to the adjacently located produce and wherein the customer fixes a said preprinted bar coded label to a selected produce bag;

(d) self-service checkout stations, containing laser bar code scanners, for receiving at a non-parallel angle said shopping carts such that the ends of said shopping carts are within one meter of the said laser bar code scanners and wherein the customer uses a said laser bar code scanner to read the said preprinted bar coded labels on the selected produce bags and to read bar coded labels on the products selected from the said shelves;

(e) the placement of said self-service checkout stations in two opposing rows wherein exit movement of said shopping carts occurs in the middle of said two opposing rows;

(f) floor markings indicating movement paths to and from said self-service checkout stations for said shopping carts;

(g) a supervisor station at an exit end of the said two opposing rows of self-service checkout stations such that said shopping carts must pass adjacent to said supervisor station upon exiting the rows; and (h) in the perimeter of the supermarket, at least one bag storage locker comprising:

(a) access code generating and printing means;

(b) an inside door means;

(c) an outside door means;

(d) a secured bag storage area between said inside door means and said outside door means;

(e) first electronically controlled locking means whereby said first electronically controlled locking means changes the locking status of the said inside door means upon reception of a first signal;

(f) second electronically controlled locking means whereby said second electronically controlled locking means changes the locking status of the said outside door means upon reception of a second signal;

(g) inside door means sensor means wherein said sensor means generates a third signal indicative of the opened vs. closed status of said inside door means;

(h) inside perimeter code input means wherein said inside code input means generates a fourth signal indicative of the entered access code;

(i) outside perimeter code input means wherein said outside code input means generates a fifth signal indicative of the entered access code;

(j) data communications means for linking said first, second, third, fourth and fifth signals to a controller means; and (k) said controller means operable for I. upon reception of said fourth signal the transmission of said first signal to unlock said inside door means;

II. upon subsequent reception of said third signal indicative of said inside door means being in a closed position the transmission of said first signal to lock said inside door means;

III. upon reception of said fifth signal wherein said fifth signal corresponds with the said fourth signal, the transmission of said second signal to unlock said 5. A supermarket incorporating self-serve checkout stations wherein said self-serve checkout stations are placed in opposing rows wherein exit movement of shopping carts occurs between said opposing rows and wherein customers position their shopping carts at non-parallel angles with respect to the said self-serve checkout stations for self-serve checkout operations, whereby a customer desiring car order service, upon leaving a said self-serve checkout station proceeds with packed bags to a bag storage locker located on the inside perimeter of the said supermarket wherein said packed bags are deposited through an inside door means within said bag storage locker, after which the customer leaves the said supermarket and returns with a motor vehicle to a location on the outside perimeter of the said supermarket corresponding to outside door means of the said bag storage locker containing the customer's said packed bags and whereupon the entry of a valid code into an outside input code device means the outside door means of the said bag storage locker containing the customer's said packed bags is unlocked enabling the customer to then remove the said packed bags for placement in the said motor vehicle.

6. A supermarket incorporating self-serve checkout stations wherein said self-serve checkout stations are placed in opposing rows wherein exit movement of shopping carts occurs between said opposing rows and wherein customers position their shopping carts at non-parallel angles with respect to the said self-serve checkout stations for self-serve checkout operations, containing in the perimeter of said supermarket, at least one bag storage locker comprising:

(a) an inside door means;
(b) an outside door means;
(c) a secured bag storage area between said inside door means and said outside door means;
(d) first electronically controlled locking means whereby said first electronically controlled locking means changes the locking status of the said inside door means upon reception of a first signal;
(e) second electronically controlled locking means whereby said second electronically controlled locking means changes the locking status of the said outside door means upon reception of a second signal;
(f) inside door means sensor means wherein said sensor means generates a third signal indicative of the opened vs. closed status of said inside door means;
(g) inside perimeter display means wherein said display means receives a fourth signal and wherein said display means displays information indicative of said fourth signal;
(h) outside perimeter code input means wherein said code input means generates a fifth signal indicative of an entered code;
(i) data communications means for linking said first and second electronically controlled locking means, said sensor means, said display means and said code input means to a controller means; and
(j) said controller means operable for
  I. upon reception of said third signal indicative of said inside door means being in a closed position, the generation and display on said display means of an access code and the transmission of said first signal to lock said inside door means;
  II. upon reception of said fifth signal, wherein said fifth signal corresponds with the said access code, the transmission of said second signal to unlock said outside door means.

7. A supermarket incorporating self-serve checkout stations wherein said self-serve checkout stations are placed in opposing rows wherein exit movement of shopping carts occurs between said opposing rows and wherein customers position their shopping carts at non-parallel angles with respect to the said self-serve checkout stations for self-serve checkout operations, containing in the perimeter of said supermarket, at least one bag storage locker comprising:

(a) an inside door means;
(b) an outside door means;
(c) a secured bag storage area between said inside door means and said outside door means;
(d) first electronically controlled locking means whereby said first electronically controlled locking means changes the locking status of the said inside door means upon reception of a first signal;
(e) second electronically controlled locking means whereby said second electronically controlled locking means changes the locking status of the said outside door means upon reception of a second signal;
(f) inside door means sensor means wherein said sensor means generates a third signal indicative of the opened vs. closed status of said inside door means;
(g) wherein said self-service checkout station generates an access code and prompts the customer to the value of said access code and generates a fourth signal indicative of said access code;
(h) outside perimeter code input means wherein said code input means generates a fifth signal indicative of an entered code;
(i) data communications means for linking said first and second electronically controlled locking means, said sensor means, said self-service checkout station and said code input means to a controller means; and
(j) said controller means operable for
  I. upon reception of said third signal indicative of said inside door means being in a closed position the transmission of said first signal to lock said inside door means;
  II. upon reception of said fifth signal wherein said fifth signal corresponds with the said fourth signal, the transmission of said second signal to unlock said outside door means.

8. A supermarket incorporating self-serve checkout stations wherein said self-serve checkout stations are placed in opposing rows wherein exit movement of shopping carts occurs between said opposing rows and wherein customers position their shopping carts an non-parallel angles with respect to the said self-serve checkout stations for self-serve checkout operations, containing in the perimeter of said supermarket, at least one bag storage locker comprising:

(a) access code generating and printing means;
(b) an inside door means;
(c) an outside door means;
(d) a secured bag storage area between said inside door means and said outside door means;
(e) first electronically controlled locking means whereby said first electronically controlled locking means changes the locking status of the said inside door means upon reception of a first signal;
(f) second electronically controlled locking means whereby said second electronically controlled locking means changes the locking status of the said outside door means upon reception of a second signal;

(g) inside door means sensor means wherein said sensor means generates a third signal indicative of the opened vs. closed status of said inside door means;

(h) inside perimeter code input means wherein said inside code input means generates a fourth signal indicative of the entered access code;

(i) outside perimeter code input means wherein said outside code input means generates a fifth signal indicative of the entered access code;

(j) data communications means for linking said first and second electronically controlled locking means, said sensor means, said inside and said outside code input means to a controller means; and (k) said controller means operable for I. upon reception of said fourth signal the transmission of said first signal to unlock said inside door means;

II. upon subsequent reception of said third signal indicative of said inside door means being in a closed position, the transmission of said first signal to lock said inside door means;

III. upon reception of said fifth signal wherein said fifth signal corresponds with the said fourth signal, the transmission of said second signal to unlock said outside door means.

9. A method for shopping in a supermarket comprising the steps of:

(a) obtaining a shopping cart at the entrance of said supermarket;

(b) pushing said shopping cart among shelves containing products;

(c) placing selected products in said shopping cart;

(d) pushing said shopping cart among produce stands containing dispensers holding produce bags and dispensers holding preprinted bar coded labels wherein said bar codes on said preprinted bar coded labels are indicative of a product code corresponding to an adjacently located produce;

(e) fixing a selected preprinted bar coded label to a selected produce bag;

(f) placing said selected produce bag in said shopping cart;

(g) pushing said shopping cart to a self-service checkout station, containing a laser bar code scanner, for receiving at a non-parallel angle said shopping cart such that an end of said shopping cart is within one meter of said laser bar code scanner;

(h) using said laser bar code scanner to read said preprinted bar coded labels on said produce bags and to read bar coded labels on products selected from said shelves;

(i) exiting said shopping cart in the middle of two opposing rows of self-service checkout stations;

(j) pushing said shopping cart past a supervisor station at an exit end of said two opposing rows of self-service checkout stations;

(k) pushing said shopping cart to bag storage locker comprising access code generating and printing means, inside door means, outside door means, a secured bag storage area between said inside door means and said outside door means, first electronically controlled locking means, second electronically controlled locking means, inside door means sensor means, inside perimeter code input means, outside perimeter code input means, data communications means for linking said first and second electronically controlled locking means, said sensor means, said inside and said outside code input means to a controller means;

(l) accessing said inside perimeter code input means;

(m) said inside perimeter code input means generating a fourth signal;

(n) said data communications means transmitting said fourth signal to said controller means;

(o) said controller means generating a first signal;

(p) said data communications means transmitting said first signal to said first electronically controlled locking means;

(q) said first electonically controlled locking means unlocking said inside door means;

(r) leaving purchased goods in said bag storage locker;

(s) closing said inside door means;

(t) said inside door means sensor means generating a third signal;

(u) said data communications means transmitting said third signal to said controller means;

(v) said controller means generating another first signal;

(w) said data communications means transmitting said another first signal to said first electronically controlled locking means;

(x) said first electronically controlled locking means locking said inside door means;

(y) exiting said supermarket;

(z) returning to an outside perimeter location of said bag storage locker;

(aa) accessing said outside perimeter code input means;

(bb) said outside perimeter code input means generating a fifth signal;

(cc) said data communications means transmitting said fifth signal to said controller means;

(dd) said controller means upon correspondence of said fifth signal with said fourth signal, generating a second signal;

(ee) said data communications means transmitting said second signal to said second electronically controlled locking means;

(ff) said second electronically controlled locking means unlocking said outside door means; and (gg) retrieving said purchased goods left in said bag storage locker.

* * * * *